US008567301B1

(12) United States Patent
Sharron

(10) Patent No.: US 8,567,301 B1
(45) Date of Patent: Oct. 29, 2013

(54) SIDE OFFSET CHARGING HANDLE

(76) Inventor: Matthew A. Sharron, Seymour, CT (US)

( * ) Notice: Subject to any disclaimer, the term of this patent is extended or adjusted under 35 U.S.C. 154(b) by 11 days.

(21) Appl. No.: 13/362,500

(22) Filed: Jan. 31, 2012

Related U.S. Application Data

(60) Provisional application No. 61/530,166, filed on Sep. 1, 2011.

(51) Int. Cl.
*F41A 7/02* (2006.01)

(52) U.S. Cl.
USPC ..... 89/1.4; 89/1.42

(58) Field of Classification Search
USPC ..... 89/1.4, 191.01, 191.02, 192, 179, 1.42; 42/90, 69.01, 69.02
See application file for complete search history.

(56) References Cited

U.S. PATENT DOCUMENTS

| | | | | |
|---|---|---|---|---|
| 3,225,653 | A * | 12/1965 | Packard | 89/1.4 |
| 7,231,861 | B1 * | 6/2007 | Gauny et al. | 89/1.4 |
| 7,798,045 | B1 | 9/2010 | Fitzpatrick et al. | |
| 7,900,546 | B2 | 3/2011 | Bordson | |
| 8,156,854 | B2 * | 4/2012 | Brown | 89/1.4 |
| 8,261,649 | B2 * | 9/2012 | Fitzpatrick et al. | 89/1.4 |
| 8,336,436 | B2 * | 12/2012 | Kincel | 89/1.14 |
| 2007/0006720 | A1 * | 1/2007 | Liao | 89/1.4 |
| 2011/0061523 | A1 * | 3/2011 | Webb | 89/128 |
| 2011/0083551 | A1 | 4/2011 | Sirochman | |
| 2011/0174139 | A1 * | 7/2011 | Olsen et al. | 89/1.4 |
| 2011/0226120 | A1 | 9/2011 | Fitzpatrick et al. | |
| 2011/0265636 | A1 * | 11/2011 | Overstreet et al. | 89/1.4 |
| 2011/0271827 | A1 * | 11/2011 | Larson et al. | 89/193 |
| 2012/0102804 | A1 * | 5/2012 | Fesas | 42/90 |
| 2012/0291612 | A1 * | 11/2012 | Kincel | 89/1.4 |

* cited by examiner

*Primary Examiner* — Bret Hayes
*Assistant Examiner* — Joshua Freeman
(74) *Attorney, Agent, or Firm* — DeLio & Peterson, LLC; Thomas E. Ciesco

(57) ABSTRACT

A charging handle for a firearm having a barrel, a stock, a receiver, a receiver trigger and a bolt reciprocating within the receiver. The firearm may include a gas tube for directing powder gases to cause operation of the bolt within the receiver. The charging handle comprising a generally elongated spar having a forward end portion in the direction of the firearm barrel and a rearward end portion in the direction of the firearm stock. The charging handle includes a latch engaging the receiver to hold the charging handle in a forward most position and, extending laterally from said rearward portion, an offset arm extending at least a portion of the length of the elongated shaft member in the direction of the firearm barrel.

13 Claims, 7 Drawing Sheets

SIDE OFFSET CHARGING HANDLE

BACKGROUND OF THE INVENTION

1. Field of the Invention

The present invention relates to charging handles for a firearm, and is particularly useful for rifles such as AR-15/M16/M4/AR-10 type weapons.

2. Description of Related Art

Firearms, particularly of the automatic or semi-automatic type, may incorporate a charging handle which performs a variety of functions. FIG. 1 shows an exploded view of a charging handle 8 and bolt carrier 6 attached to a firearm 80. The firearm 80 includes a barrel 82, a fore stock 92, a butt stock 84, an upper receiver 86, a lower receiver 88, and a receiver trigger 90. The firearm may also include a removable magazine cartridge 5. A bolt 19 is engaged with the bolt carrier 6. In operation, the bolt carrier 6 reciprocates within the upper receiver 86. The firearm 80 includes a gas tube 25 extending from the barrel 82 to a bolt carrier 6 and an eyesight 39. The eyesight 39 has an internal chamber 37 in communication with one end of the gas tube 25 and with at least one opening 33 in the barrel 82. Pressurized gas from the firing of a round passes from the barrel 82, through the barrel opening 33, through the chamber 37 and into the gas tube 25. The gas tube directs powder gases from the barrel to the bolt carrier 6, operating the bolt carrier 6 within the upper receiver 86.

The charging handle allows the operator to pull the bolt carrier 6 to the rear which may eject a spent shell casing or unfired cartridge from the chamber, load a round from the magazine or by hand through the chamber or clear a jam from a double feed or misfire. The charging handle may also verify that the weapon's chamber is clear of any rounds or other obstructions. The charging handle may position the bolt into the chamber, acting as a forward assist or release a bolt locked to the rear, such as would be the case after firing the last round on a firearm equipped with a last-round-hold-open feature.

The prior art charging handle 8 as shown in FIG. 2 includes a spar 14, finger grip 16 and a release lever 12 pivotably connected near the end of the spar 14 adjacent to the finger grip. In their normal positions, finger grip 16 and lever 12 are located to the rear of receiver trigger 90. The release lever 12 is pivotally connected to the spar 14 with a roll pin 10. The charging handle includes a carrier contact lug 18, spar protrusions 20 and spar opening 15. The spar protrusions 20 lock the spar within a groove along a portion of the length of the upper receiver 86 allowing the charging handle spar to slidingly glide along the inner chamber of the firearm upper receiver 86. The bolt carrier rearward movement releases a spring loaded flap covering the ejection port on the upper receiver. FIG. 3 shows a side view of the charging handle 8 before it is slidingly mounted with the bolt carrier 6. Attached to the bolt carrier 6 is a gas key 3 extending upward from the bolt carrier 6. The spar 14 includes a bottom groove 4 which extends from a rear portion of the charging handle 8 near the release lever 12 to the carrier contact lug 18 and allows the bolt carrier gas key 3 to slide in the groove 4 from a position wherein the bolt carrier gas key 3 is toward the carrier contact lug 18 to a position wherein the bolt carrier gas key 3 is toward the finger grip 16. When the bolt carrier 6 is in the most forward position, the gas key 3 protrudes through an opening 15 of the charging handle 8 so that the gas key 3 is in communication with the gas tube 25. The pressurized gas which is forced rearward through the gas tube 25 enters the gas key 3, passes through the gas key into the bolt carrier 6, forcing the bolt carrier 6 against the bolt 19. The bolt 19 is forced in a direction away from the bolt carrier 6. Since the bolt 19 is in its forwardmost position in the upper receiver, the force of the bolt away from the bolt carrier sends the bolt carrier 6 rearward. This sliding action allows for reciprocating movement of the bolt carrier by the gas charges without movement of the charging handle with respect to the upper receiver. The carrier contact lug 18 at the lower forward end of the charging handle central spar 14 engages protrusion 17 on the bolt carrier near the bolt carrier gas key 3.

There are several deficiencies in this type of charging handle 8. As shown in FIG. 1 the lever 12 is located to the rear of receiver trigger 90, making it awkward for the user's hand to reach back after firing a round to the lever behind the receiver trigger to charge the next round. The prior art charging handle does not permit the shooter to keep the weapon in close, restricts the tactical stance, and does not optimize the change of positioning time from holding the fore stock during firing to charging afterwards. Moreover, lever 12 is difficult to grip with the fingers, especially when the operator is wearing gloves. It is especially difficult to reach the finger grip 16 and release lever 12 when there is an attachment along the top of the upper receiver such as an aiming device or scope. A scope body is positioned close to the upper receiver, making it difficult to place the fingers between the scope body and upper receiver where the finger grip 16 and release lever 12 are located.

SUMMARY OF THE INVENTION

Bearing in mind the problems and deficiencies of the prior art, it is therefore an object of the present invention to provide a sturdy charging handle which allows an operator to charge a firearm.

It is another object of the present invention to provide a charging handle which provides improved leverage over the prior art.

A further object of the invention is to provide a charging handle which is easy and comfortable to grip.

It is yet another object of the present invention to provide a charging handle which positions the charging handle release trigger close to the firearm forestock.

It is still another object of the present invention to provide a charging handle which positions the charging handle release lever clear of accessories along the top rail of the upper receiver.

Still other objects and advantages of the invention will in part be obvious and will in part be apparent from the specification.

The above and other objects, which will be apparent to those skilled in the art, are achieved in the present invention which is directed to a charging handle for a firearm having a barrel, a fore stock, a butt stock, a receiver, a receiver trigger and a bolt reciprocating within the receiver. The charging handle comprises a generally elongated spar having a forward end portion in the direction of the firearm barrel and a rearward end portion in the direction of the firearm stock. The charging handle has a latch engaging the receiver to hold the charging handle in a forward most position and, extending laterally from said rearward portion, an offset arm extending at least a portion of the length of the elongated shaft member in the direction of the firearm barrel.

The charging handle offset arm may include a forward portion with a movable, finger-operated charging handle trigger, forward of the receiver trigger, operable to disconnect the latch holding the charging handle in the forward most position with respect to the receiver and enable rearward movement of the charging handle to charge the firearm. The finger-operated charging handle trigger may be pivotably attached to the offset arm and the offset arm may include a charging handle trigger extension attached to the charging handle trigger at one end of the extension and the latch at the opposite end for translating the movement of the charging handle trigger to the latch during operation of the charging handle trigger.

The charging handle may include a charging handle trigger extension attached to the charging handle trigger at one end and to a disconnect lever on the opposite end whereby movement of the charging handle trigger translates through the charging handle trigger extension to the disconnect lever, rotating the latch to disengage the charging handle from the upper receiver. The finger-operated charging handle trigger may be pivotably attached to the offset arm.

The firearm may include a gas tube for directing powder gases to cause operation of the bolt within the receiver. The offset arm may be spaced from and parallel to the elongated spar. The offset arm may be disposed on the left side of the firearm or the right side of the firearm when the firearm is in the firing position.

The offset arm may extend substantially the entire length of the elongated shaft member in the direction of the firearm barrel. The offset arm may include a disconnect lever movable with respect to the offset arm to transmit movement of the finger-operated charging handle trigger to disconnect the latch. The finger-operated charging handle trigger may be pivotable on the forward portion of the offset arm to rotate and bias toward the receiver when the charging handle trigger is not in use.

Another aspect of the invention is directed to a charging handle for a firearm having a barrel, a fore stock, a butt stock, a receiver, a receiver trigger, a bolt reciprocating within the receiver and a gas tube for directing powder gases to cause operation of the bolt within the receiver. The charging handle comprises a generally elongated spar having a forward end portion in the direction of the firearm barrel and a rearward end portion in the direction of the firearm stock. The charging handle has a latch engaging the receiver to hold the charging handle in a forward most position and, extending laterally from said rearward portion. The charging handle includes an offset arm extending at least a portion of the length of the elongated shaft member in the direction of the firearm barrel and including a forward portion with a movable, finger-operated charging handle trigger, forward of the receiver trigger, operable to disconnect the latch holding the charging handle in the forward most position with respect to the receiver and enable rearward movement of the charging handle to charge the firearm.

The charging handle includes a charging handle trigger extension attached to the charging handle trigger at one end and to a disconnect lever on the opposite end whereby movement of the charging handle trigger translates through the charging handle trigger extension to the disconnect lever, rotating the latch to disengage the charging handle from the upper receiver. The finger-operated charging handle trigger may be pivotably attached to the offset arm.

Another aspect of the invention is directed to a method of using a charging handle on a firearm. The method comprises providing a firearm having a barrel, a fore stock, a butt stock, a receiver, a receiver trigger, a bolt reciprocating within the receiver and providing a charging handle comprising a generally elongated spar having a forward end portion in the direction of the firearm barrel and a rearward end portion in the direction of the firearm stock. The charging handle has a latch engaging the receiver to hold the charging handle in a forward most position and, extending laterally from the rearward portion and an offset arm extending at least a portion of the length of the elongated shaft member in the direction of the firearm barrel. The offset arm has at a forward portion thereof a movable, finger-operated charging handle trigger, forward of the receiver trigger, operable to disconnect the latch holding the charging handle in the forward most position with respect to the receiver and enable rearward movement of the charging handle to charge the firearm. The method includes holding the firearm with a first hand engaging the receiver trigger and a second hand holding the fore stock, using the second hand to engage the charging handle trigger at a position forward of the receiver trigger and moving the charging handle trigger to disconnect the latch holding the charging handle in the forward most position with respect to the receiver and enable rearward movement of the charging handle to charge the firearm.

The firearm may include a gas tube for directing powder gases to cause operation of the bolt within the receiver. The charging handle may include a charging handle trigger extension attached to the charging handle trigger at one end and to a disconnect lever on the opposite end whereby movement of the charging handle trigger translates through the charging handle trigger extension to the disconnect lever, rotating the latch to disengage the charging handle from the upper receiver. The finger-operated charging handle trigger may be pivotably attached to the offset arm. The step of moving the charging handle trigger to disconnect the latch may include pivoting the charging handle trigger and pulling back on the charging handle trigger.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
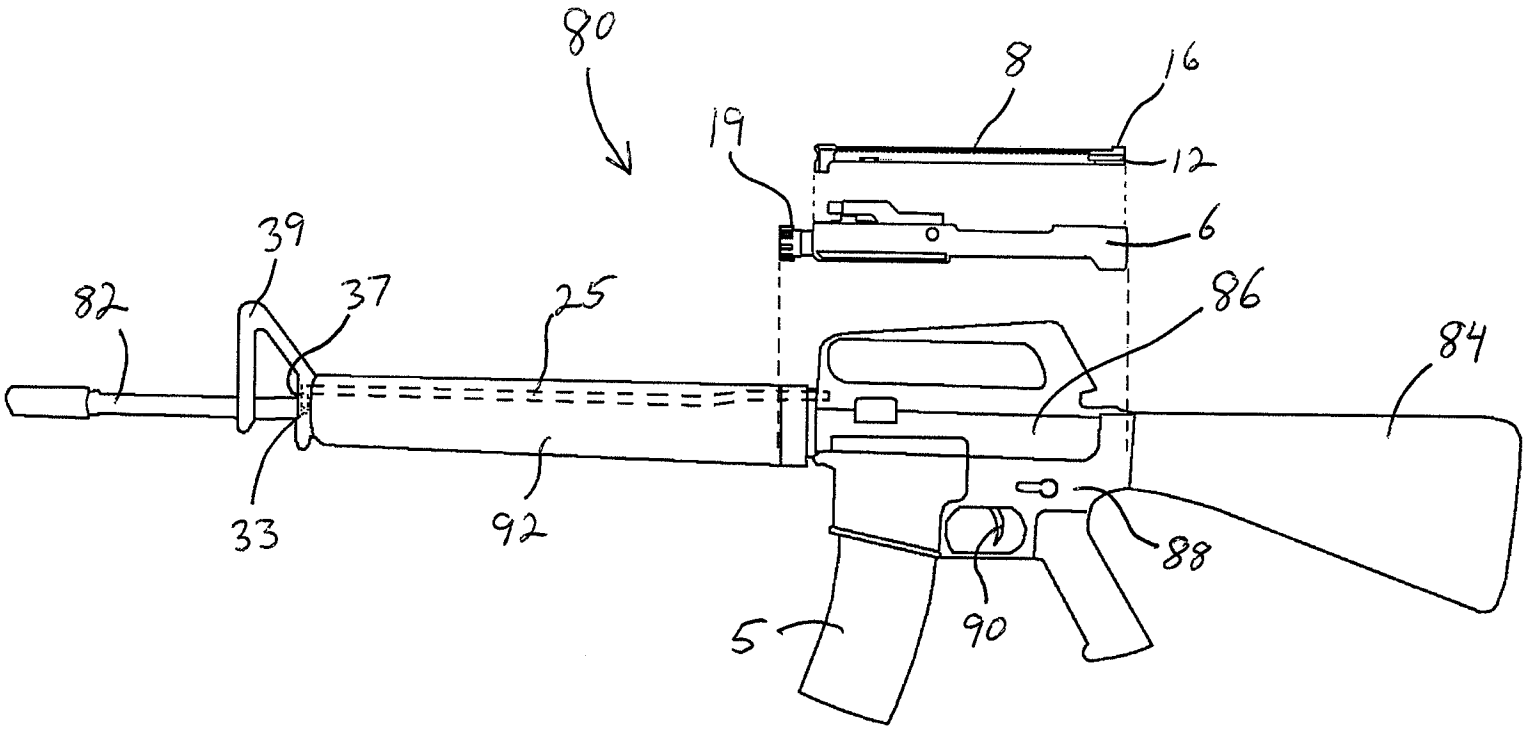
FIG. 1 (PRIOR ART)
FIG. 1 is an exploded view of a prior art charging handle and a bolt on a firearm.
Figure 2:
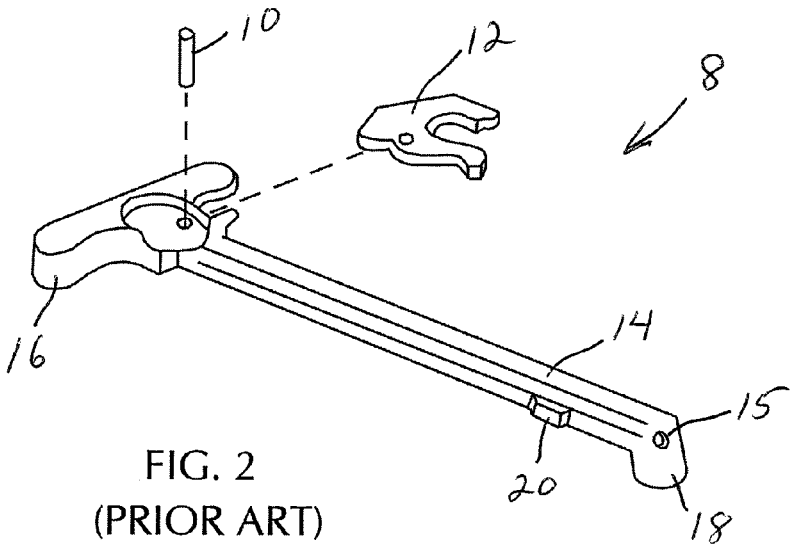
FIG. 2 (PRIOR ART)
FIG. 2 is a perspective view of the charging handle according to the prior art.
Figure 3:
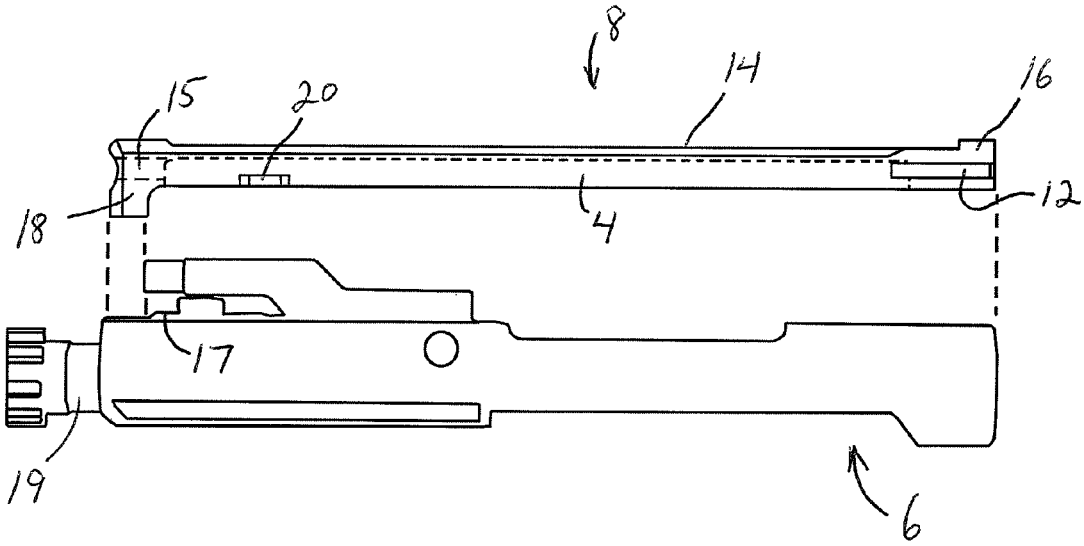
FIG. 3 (PRIOR ART)
FIG. 3 is the prior charging handle and bolt carrier.
Figure 4:
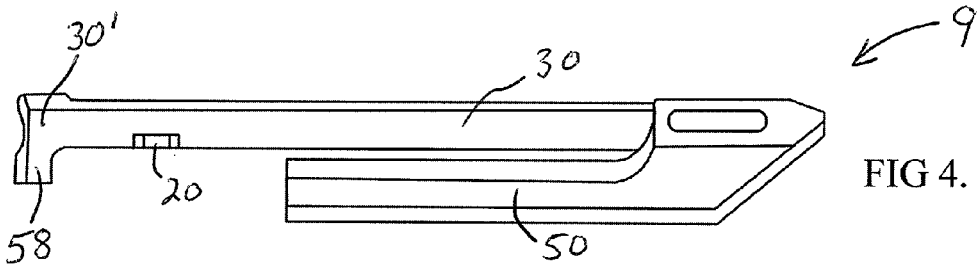
FIG. 4 is a left side elevational view of the charging handle according to the present invention.
Figure 5:
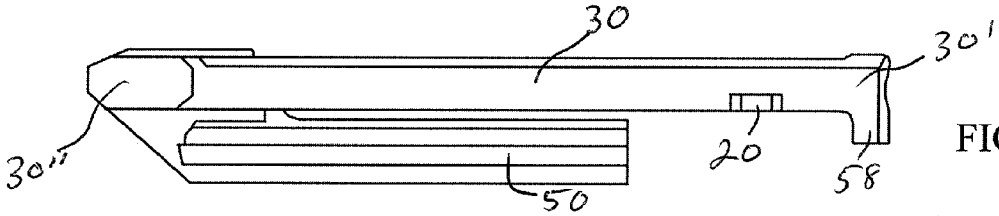
FIG. 5 is a right side elevational view of the charging handle according to the present invention.
Figure 6:
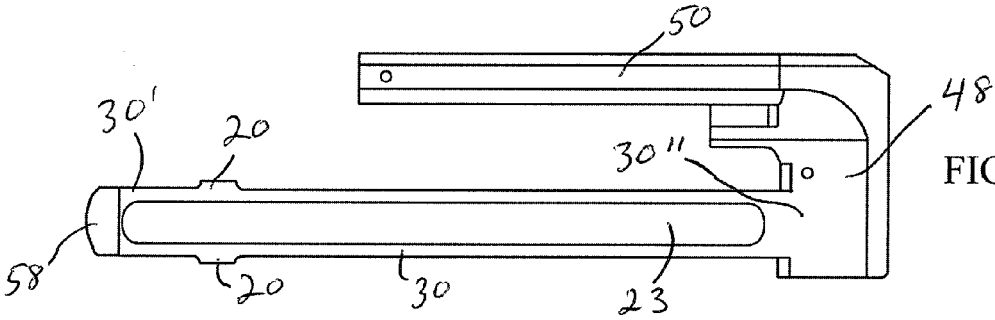
FIG. 6 is a bottom elevational view of the charging handle according to the present invention.
Figure 7:
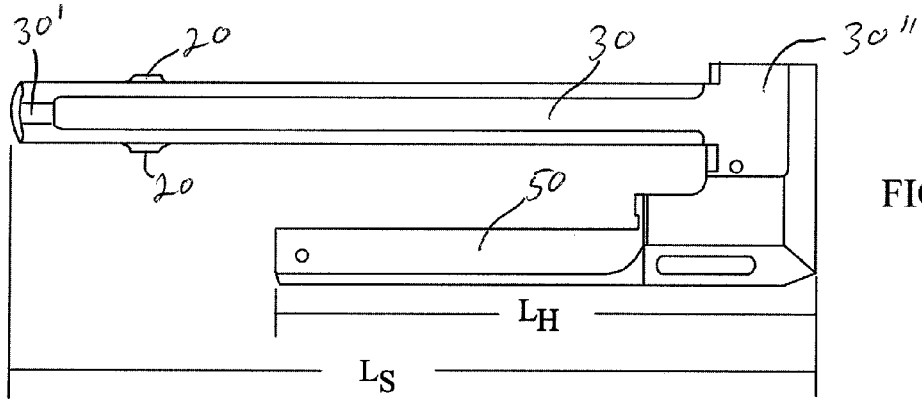
FIG. 7 is a top side elevational view of the charging handle according to the present invention.

In describing the preferred embodiment of the present invention, reference will be made herein to FIGS. 4-16 of the drawings in which like numerals refer to like features of the invention.

The charging handle 9 as shown in FIGS. 4-7 comprises a spar or generally elongated shaft member 30 having a forward end portion 30' in the direction of the firearm barrel and a rearward end portion 30" in the direction of the firearm stock. The elongated shaft member includes a groove 23 along the spar bottom which extends from about the forward end portion 30' to the rearward end portion 30". A bolt carrier contact lug 58 extends downward from the forward end portion 30' of the spar 30. Spar protrusions 20 extend outward from the spar 30. Extending laterally from said rearward portion, the charging handle 9 also includes an offset arm 50 spaced from and extending parallel to at least a portion of the length of the elongated shaft member 30 in the direction of the firearm barrel. The charging handle offset arm 50 length $L_H$ may extend substantially the entire length $L_S$ of the spar or elongated shaft member 30 in the direction of the firearm barrel, although it is preferably at least one-quarter (¼) and more preferably at least one-half (½) of the length of the spar or shaft member 30. A lateral portion 48 connects the offset arm 50 to the elongated shaft member 30 at the rear portions of both. The offset arm 50 is preferably offset from the spar 30 laterally outward and downward so the offset arm is positioned close to the upper receiver. While the embodiments herein may be shown with the charging handle offset arm positioned to the left of the rifle (for right-handed users), it may be reversed to extend on the right side of the rifle (for left-handed users).

Figure 8:
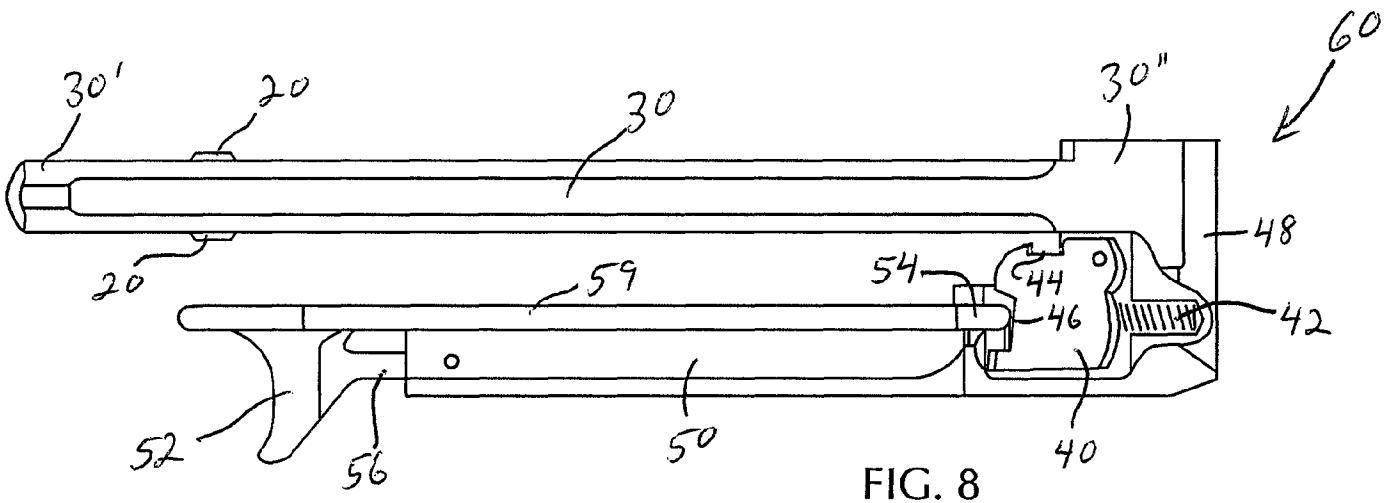
FIG. 8 is a top elevational view of the charging handle according to the present invention with the rearward end portion cutaway to show the latch and latch spring.
Figure 9:
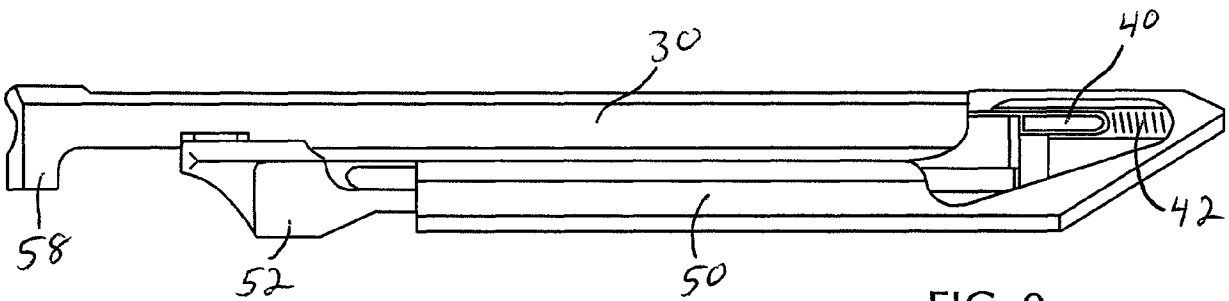
FIG. 9 is a side elevational view of the charging handle according to the present invention with the rearward end portion cutaway to show the latch and latch spring.

As shown in the cutaway views of one embodiment of the offset charging handle of FIGS. 8 and 9, a forward portion of the offset arm includes a movable, finger-operated charging handle trigger 52. The charging handle trigger 52 is forward of the receiver trigger, and is operable to disconnect a latch 40 holding the charging handle in the forward most position with respect to the receiver and enable rearward movement of the charging handle to charge the rifle.

The latch 40 for engaging an upper receiver of a rifle holds the charging handle 60 in a forward most position when engaged. The latch 40 includes a first notch 44 engagable with the rifle upper receiver 86 and a second notch 46 engagable with a disconnect lever 54 on the offset arm 50. The charging handle 60 includes a latch spring 42 to rotationally bias the latch 40 for latch engagement to the rifle upper receiver 86. The disconnect lever 54 is movable with respect to the offset arm 50 to transmit movement of the finger-operated charging handle trigger 52 through charging handle trigger extension member 59 to urge the latch rotationally to disconnect the latch 40 from the upper receiver 86. A guide 56 along offset arm 50 ensures smooth motion of the charging handle trigger 52, charging handle trigger extension 59 and disconnect lever 54. Spar body 48 connects the spar 30 and offset arm 50.

One embodiment of charging handle 60 has an offset arm 50 and disconnect lever 56 that runs along the lower left side of the upper receiver. A finger-operated charging handle trigger 52 (finger pull) is located forward of the receiver trigger 90 and alongside the receiver 86, on the same side as the user's hand that holds the fore stock, and causes the disconnect lever to move. For a right-handed shooter, the right hand will be positioned to engage and pull the rifle receiver trigger 90, and the left hand will hold the fore stock during firing. For a left-handed user, the hand positions are reversed. The hand holding the fore stock is able to engage charging handle trigger 52 by making only a minor movement from the fore stock holding position to alongside the receiver 86 (forward of receiver trigger 90), instead of having to move off the fore stock to the aft end of the receiver (behind receiver trigger 90) where the prior art charging handle finger grip lever is located. When the disconnect lever 56 is pulled back, using the left hand, for example, the disconnect lever 56 slides back independent of the charging handle 50 itself. This rearward movement allows a vertical tab 54 at the upper rear of the disconnect lever 56 to come in contact with a rotatable latch 40 which normally holds the charging handle at its forward most position. This latch 40 then rotates, unlocking from a notch 44 at the rear on the left side of the upper receiver 86. Once unlocked, the charging handle 60 is free to travel to its rearward most position. The bolt 19 and carrier 6, located just below the charging handle in the upper receiver 86, also move rearward via a loose connection between a bolt carrier contact lug 58 on the bottom and the front end 30' of the offset arm charging handles central spur 30 and a notch at the front and top of the carrier. The charging handles central spar 30 resides in a slot in the upper receiver 86 above the carrier. When released, the charging handle, bolt and carrier are sent forward via a return spring located in the stock behind the carrier. The latch 40 locks in the upper receiver's notch on completion of forward movement.

Figure 10:
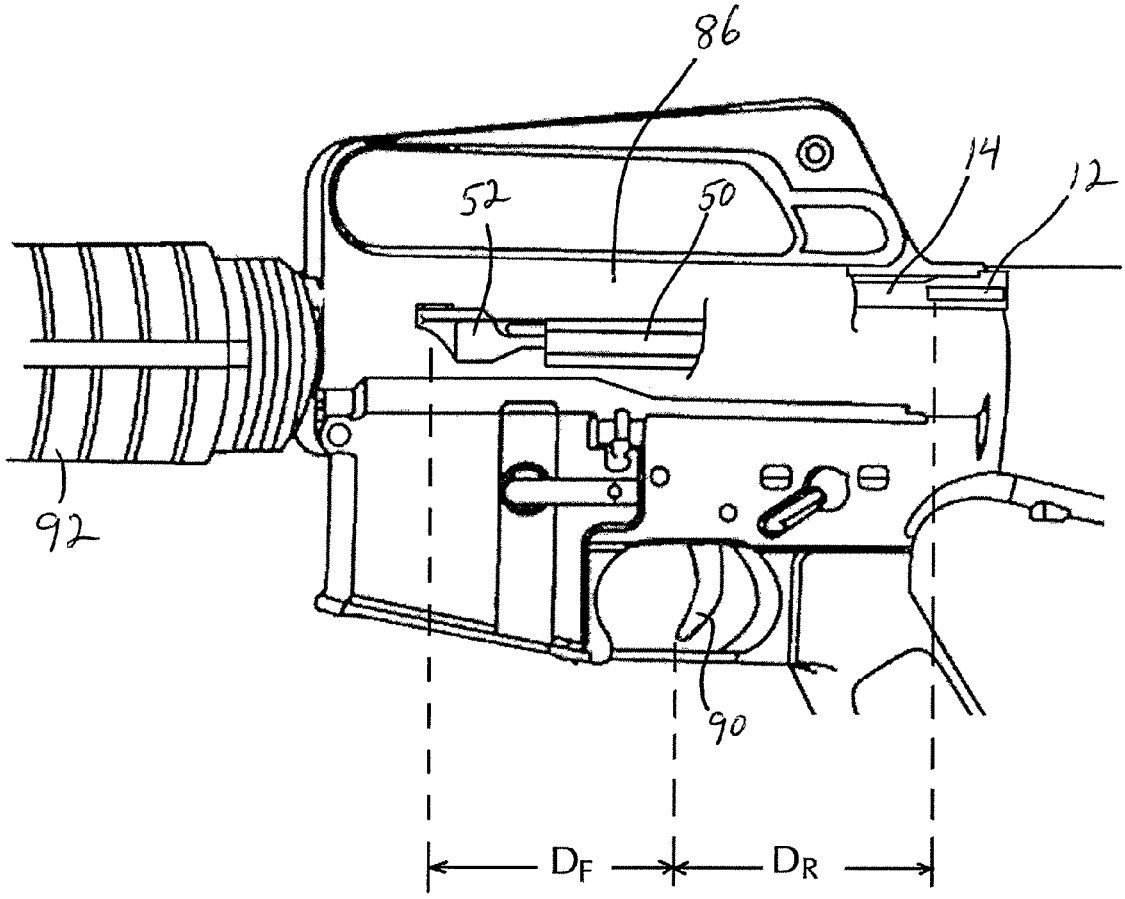
FIG. 10 is a side view of the rifle upper and lower receiver showing the position of the charging handle trigger of the present invention and charging handle trigger of the prior art with respect to the receiver trigger.

FIG. 10 is a side view of the rifle upper and lower receiver showing the relative forward position $D_F$ of the charging handle trigger 52 of the present invention with respect to the receiver trigger 90 and the relative rearward position DR of the charging handle trigger 12 of the prior art with respect to the receiver trigger 90. Only the charging handle triggers 52, 12 and the elongated shaft members 50, 14 of both the present invention and prior art are shown on the upper receiver 86 and are for relative position comparison. The operator has a shorter distance to move the hand which is initially on the fore stock 92 when operating the charging handle trigger 52 than either the receiver trigger 90 or the charging handle trigger 12 of the prior art.

Figure 11:
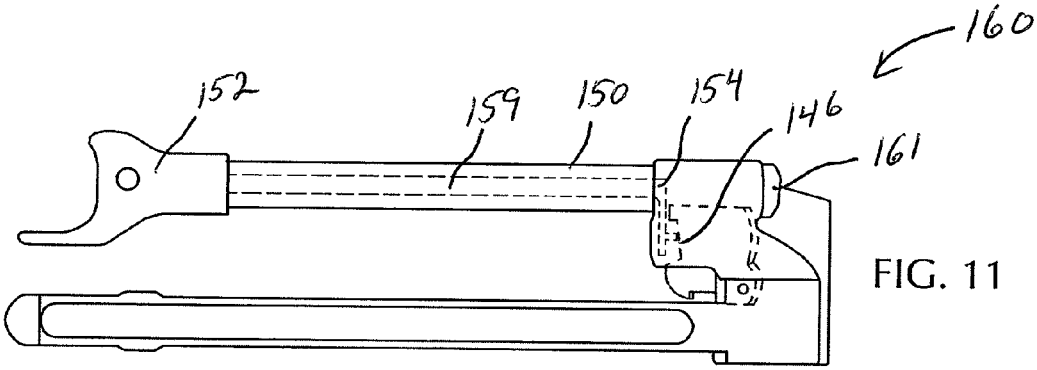
FIG. 11 is a bottom elevational view of a second embodiment of the charging handle according to the present invention.
Figure 12:
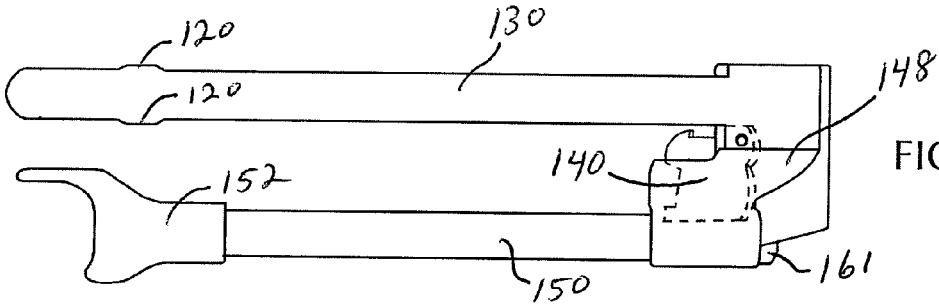
FIG. 12 is a top elevational view of the charging handle shown in FIG. 10.

FIGS. 11 and 12 show the top, bottom, right and left views of a second embodiment of the left-side offset charging handle 160 which includes individual parts assembled to make the charging handle. The charging handle is similar to the embodiment in FIGS. 8 and 9, so the identifiers in FIGS. 11 and 12 include a number 1 added in front to indicate a similar feature. The charging handle includes an elongated shaft member 130 having a bottom groove 123 and offset arm 150 which is attached to spar body 148 with a screw 161. The charging handle includes an internal charging handle trigger extension 159 to transmit the movement of charging handle trigger 152 to lever 154 engages in latch notch 146. The operation of the charging handle trigger 152 disengages latch notch 144 from the upper receiver, allowing charging by the charging handle. The elongated shaft member 130, which may also be referred to as a charging handle central spar, resides in a slot in the upper receiver 86 of the rifle above the carrier. The finger-operated charging handle trigger 152 may be retractably mounted on the offset arm 150. The charging handle trigger 152 is attached to a charging handle trigger extension 159 which engages the latch 140 at latch second notch 146. The elongated shaft member 130 includes a groove 123 for the bolt carrier gas key 3. The latch 140 includes a first notch 144 for engaging the upper receiver. Spar protrusions 120 extend outwardly from spar 130. A bolt carrier contact lug 158 on the bottom and the forward end of the offset arm charging handles spar 130.

Figure 13:
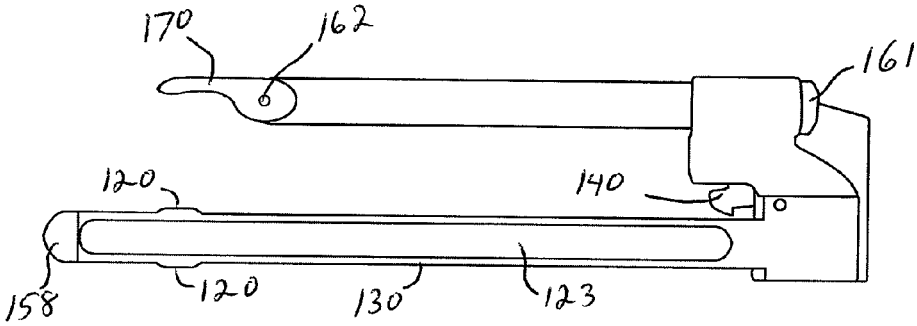
FIG. 13 is a bottom elevational view of a third embodiment of the charging handle according to the present invention.
Figure 14:
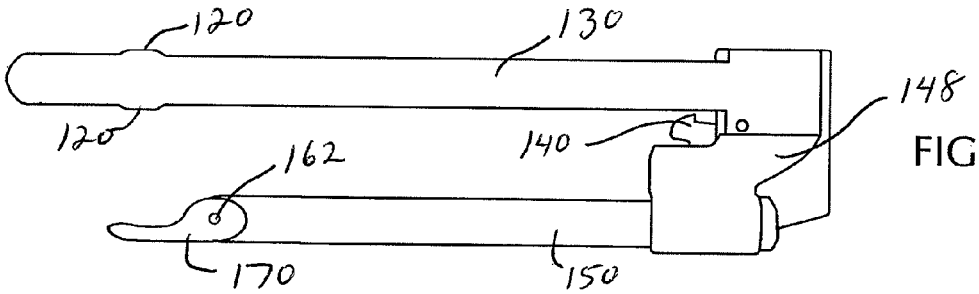
FIG. 14 is a top elevational view of the charging handle shown in FIG. 12.

In another embodiment shown in FIGS. 13 and 14, a finger-operated charging handle trigger may be retractably mounted on a pivot and biased toward the receiver. The finger-operated charging handle trigger 170 may be pivotable about pin 162 on the forward portion of the offset arm to rotate and bias toward the receiver when the charging handle trigger is not in use. Spar protrusions 120 extend outward from each side of the spar 130.

Figure 15:
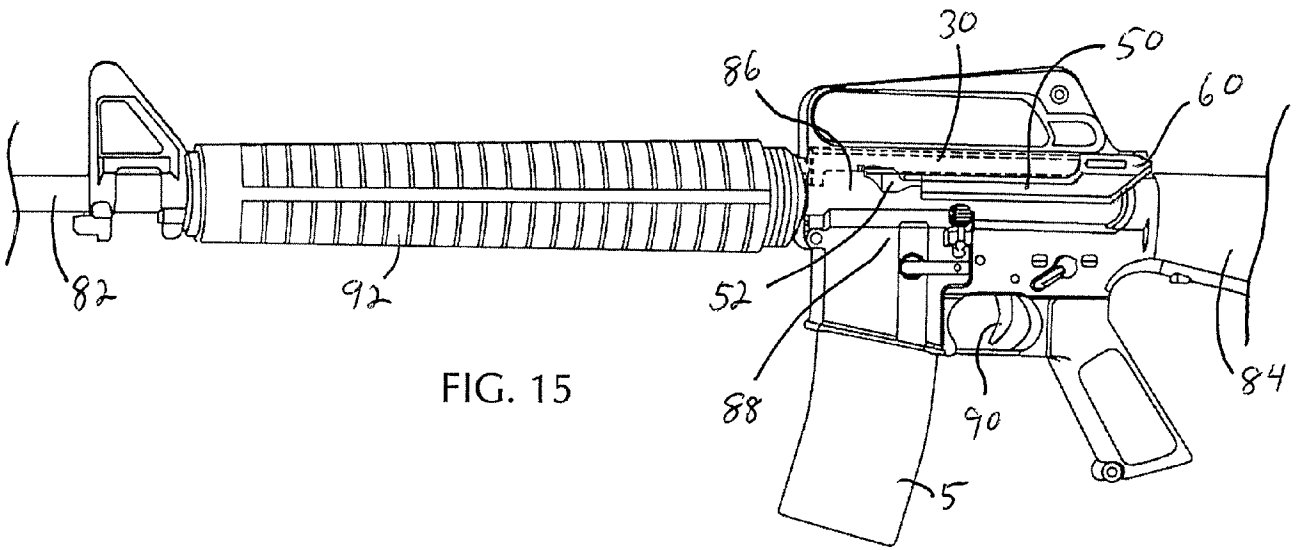
FIG. 15 is a left side elevational view of a charging handle according to the present invention on an assault rifle with a cross sectional view of the upper receiver to show the elongated shaft member within the upper receiver.
Figure 16:
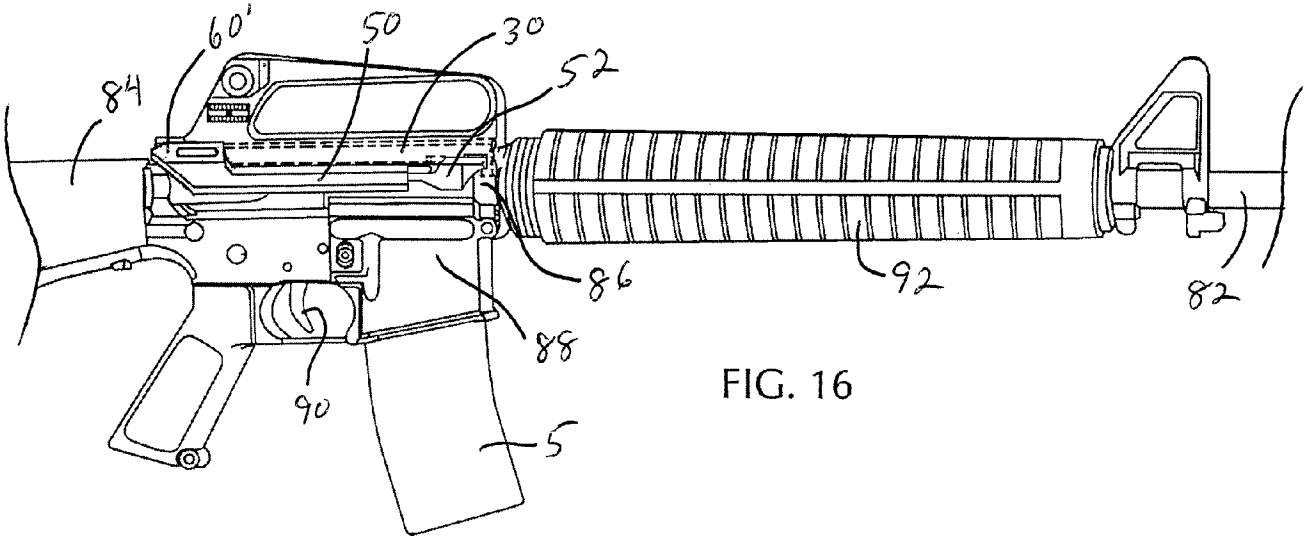
FIG. 16 is a right side elevational view of a charging handle according to the present invention on an assault rifle with a cross sectional view of the upper receiver to show the elongated shaft member within the upper receiver.

FIG. 15 shows a left side offset charging handle mounted on the left side of the upper receiver of an assault rifle which includes a barrel 82, a fore stock 92, a butt stock 84, a lower receiver 88, an upper receiver 86 and a receiver trigger 90. The charging handle includes an elongated shaft member or spar 30, an offset arm 50 and a charging handle trigger 52. FIG. 16 shows a right side offset charging handle mounted on the right side of the upper receiver 86 of an assault rifle. In both the left side offset charging handle 60 in FIG. 15 and the right side offset charging handle 60' in FIG. 16, the charging handle trigger 52 is forward of the lower receiver trigger 90 rather than rearward of the receiver trigger 90, allowing for shorter hand movements when the operator's hand is initially on the rifle fore stock 92. The rifle may include a magazine 5.

In a method of using the side offset charging handle, any of the embodiments as shown in FIGS. 8, 9 and 11-16 may be used. The method includes the operator holding the firearm with a first hand engaging the receiver trigger and a second hand holding the fore stock. The operator would then engage the charging handle trigger using the second hand. The charging handle trigger is at a position forward of the receiver trigger. The operator would then move the charging handle trigger to disconnect the latch holding the charging handle in the forward most position with respect to the receiver and enable rearward movement of the charging handle to charge the firearm. If the operator wants to discharge the weapon, the step of firing the firearm may be included before the step of charging the firearm in the case where the firearm was ready to fire, or after charging the firearm in the case where the firearm had not been charged or where an operator uses the charging handle to clear a jam.

These devices vary significantly between rifles but may occur in the form of a small protrusion or hook from the side of the bolt, a pumped slide or lever. The slide in a pistol performs similar actions as a cocking handle.

There are also additional factors concerning the design of cocking handles, and some of them are especially important if the weapon is for tactical use. One issue is the mean time between failures due to metal fatigue. Just like other parts, cocking handles sometimes break when weapons are heavily used. Another issue is whether the cocking handle is sufficiently large for use by someone wearing heavy gloves and protective clothing.

The charging handle according to the present invention provides a sturdy charging handle which allows an operator to charge a firearm, particularly a rifle, and provides improved leverage over the prior art. The charging handle includes a release lever for releasing the offset arm for charging and is easy and comfortable to grip. The charging handle of the present invention allows the shooter to keep the weapon in close, maintaining a more positive tactical stance. This charging handle also speeds and simplifies the charging of the AR-15/M16/M4 type weapon by shortening the change of positioning time from holdings to charging with the left hand. A larger version may also be used on the AR-10 type weapon. The charging handle of the present invention positions the charging handle release lever clear of accessories along the top rail of the upper receiver.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A charging handle for a firearm having a barrel, a fore stock, a butt stock, a receiver, a receiver trigger, a bolt reciprocating within the receiver and a gas tube for directing powder gases to cause operation of the bolt within the receiver, said charging handle comprising:

a generally elongated spar having a forward end portion in the direction of the firearm barrel and a rearward end portion in the direction of the firearm stock, said charging handle having a latch engaging the receiver to hold the charging handle in a forward most position and, extending laterally from said rearward portion; and an offset arm extending at least a portion of the length of the elongated spar in the direction of the firearm barrel and including an offset arm forward portion with a movable, finger-operated charging handle trigger, forward of the receiver trigger, operable to disconnect the latch holding the charging handle in the forward most position with respect to the receiver and enable rearward movement of the charging handle to charge the firearm, wherein the offset arm is secured to the receiver only by the elongated spar.

2. The charging handle of claim 1 including a charging handle trigger extension attached to the charging handle trigger at one end and to a disconnect lever on the opposite end whereby movement of the charging handle trigger translates through the charging handle trigger extension to the disconnect lever, rotating the latch to disengage the charging handle from the receiver.

3. The charging handle of claim 1 wherein the finger-operated charging handle trigger is pivotably attached to the offset arm.

4. The charging handle of claim 1 wherein said offset arm is spaced from and parallel to the elongated spar.

5. The charging handle of claim 1 wherein said offset arm is disposed on the left side of the firearm when the firearm is in the firing position.

6. The charging handle of claim 1 wherein said offset arm is disposed on the right side of the firearm when the firearm is in the firing position.

7. The charging handle of claim 1 wherein said offset arm extends substantially the entire length of the elongated spar in the direction of the firearm barrel.

8. The charging handle of claim 1 wherein said offset arm includes a disconnect lever movable with respect to the offset arm to transmit movement of the finger-operated charging handle trigger to disconnect the latch.

9. The charging handle of claim 1 wherein the finger-operated charging handle trigger is pivotable on the forward portion of the offset arm to rotate and bias toward the receiver when the charging handle trigger is not in use.

10. A method of using a charging handle on a firearm comprising:

providing a firearm having a barrel, a fore stock, a butt stock, a receiver, a receiver trigger, a bolt reciprocating within the receiver;

providing a charging handle comprising a generally elongated spar having a forward end portion in the direction of the firearm barrel and a rearward end portion in the direction of the firearm stock, said charging handle having a latch engaging the receiver to hold the charging handle in a forward most position and, securely fixed to and extending laterally from said rearward portion and an offset arm extending at least a portion of the length of the elongated spar in the direction of the firearm barrel, the offset arm supported solely by said rearward end portion and having at a forward portion thereof a movable, finger-operated charging handle trigger, forward of the receiver trigger, operable to disconnect the latch holding the charging handle in the forward most position with respect to the receiver and enable rearward movement of the charging handle to charge the firearm;

holding the firearm with a first hand engaging the receiver trigger and a second hand holding the forestock;

using the second hand to engage the charging handle trigger at a position forward of the receiver trigger; and moving the charging handle trigger to disconnect the latch holding the charging handle in the forward most position with respect to the receiver and enable rearward movement of the charging handle to charge the firearm.

11. The method of claim 10 wherein the firearm includes a gas tube for directing powder gases to cause operation of the bolt within the receiver.

12. The method of claim 10 wherein the charging handle includes a charging handle trigger extension attached to the charging handle trigger at one end and to a disconnect lever on the opposite end whereby movement of the charging handle trigger translates through the charging handle trigger extension to the disconnect lever, rotating the latch to disengage the charging handle from the upper receiver.

13. The method of claim 10 wherein the finger-operated charging handle trigger is pivotably attached to the offset arm and wherein the step of moving the charging handle trigger to disconnect the latch includes pivoting the charging handle trigger and pulling back on the charging handle trigger.

* * * * *